United States Patent [19]

McClurg

[11] 4,042,117

[45] Aug. 16, 1977

[54] WEAR PLATE

[75] Inventor: Carl D. McClurg, Lockbourne, Ohio

[73] Assignee: Buckeye International, Inc., Columbus, Ohio

[21] Appl. No.: 593,196

[22] Filed: July 7, 1975

[51] Int. Cl.[2] ..... B61G 9/20

[52] U.S. Cl. ..... 213/50.5; 213/69

[58] Field of Search ..... 213/50.5, 50, 60, 61, 213/69; 267/158; 308/3 R; 24/262, 813; 52/716

[56] References Cited

U.S. PATENT DOCUMENTS

| | | | |
|---|---|---|---|
| 1,678,141 | 7/1928 | Hoerr | 213/50.5 |
| 1,686,733 | 10/1928 | Couch | 213/50.5 |
| 1,954,537 | 4/1934 | Purcell | 213/60 |
| 2,149,840 | 3/1939 | Christianson | 213/61 |
| 2,295,444 | 9/1942 | Woodward | 24/81 B |
| 2,784,814 | 3/1957 | Bright | 24/81 B |
| 3,188,772 | 6/1965 | Tennison | 52/716 X |
| 3,246,770 | 4/1966 | Gierlach | 213/50.5 X |

FOREIGN PATENT DOCUMENTS

| | | | |
|---|---|---|---|
| 838,970 | 5/1952 | Germany | 52/716 |

*Primary Examiner*—Robert B. Reeves
*Assistant Examiner*—John P. Shannon
*Attorney, Agent, or Firm*—Charles F. Pigott, Jr.

[57] ABSTRACT

A wear plate is disclosed herein for use in a railway car center sill to prevent or minimize wearing of the upper bearing surface of each of the horizontal key slots, due to the rubbing action of a draft key. The wear plate includes an elongated wear face which is positioned between the upper bearing surface and key and covers the upper bearing surface. At least one upwardly-extending flange is provided for securing the wear plate to the center sill and for maintaining the wear face in position to protect the upper bearing surface.

6 Claims, 11 Drawing Figures

11
16
20
22
50
10
56
48
42
38
66
74
30
28
34
18
12
40
14

22
3.
38
52
74
5.
66
70
64
5.
30
18
62
34
46
54
44
3.
28

WEAR PLATE

BACKGROUND OF THE INVENTION

This invention relates to a replaceable wear plate for installation in a railway car center sill to protect the upper bearing surface of each of the draft key slots.

In a railroad car a coupler and its associated yoke are secured at each end of the car to a center sill casting by a horizontal draft key. The key passes through key slots in the coupler shank and yoke hood, and the outer ends of the key are confined within a horizontal key slot in each of the center sill side walls.

The weight of the coupler extending outwardly from the sill tends to raise the butt end of the coupler shank, thereby raising the draft key until it contacts the upper bearing surface of each of the sill key slots.

When cars are coupled together and the train is in motion, the cars have a tendency to "run-in" and "run-out" (i.e., move longitudinally toward and away from each other), which causes the couplers to move inwardly and outwardly. When the draft key is in contact with the upper bearing surface of the sill key slots and the cars are moving, the key rubs against the upper bearing surface causing it to wear. The bottom bearing surface, which is also contacted by the key, experiences little, if any, wear and has not presented a wear problem.

In order to repair a worn upper bearing surface, the car must be taken out of service, and depending upon the condition of the sill, either the entire sill is replaced or the worn area is repaired by welding, which is both costly and time-consuming.

It is, therefore, an object of this invention to substantially prevent or reduce wear of the upper bearing surface of the sill key slots in order to minimize the cost and frequency of repairing the center sill.

This and other objects of this invention will become apparent from the following description and appended claims.

SUMMARY OF THE INVENTION

There is provided by this invention a replaceable wear plate for installation in a center sill casting against the upper bearing surface of each key slot and between the key and upper bearing surface to protect the key slot from the rubbing action of the draft key. By being replaceable, servicing costs and time are minimized. In one embodiment the wear plate can be installed without removing the coupler and its yoke from the sill.

DESCRIPTION OF THE ILLUSTRATIVE EMBODIMENT

Figure 1:
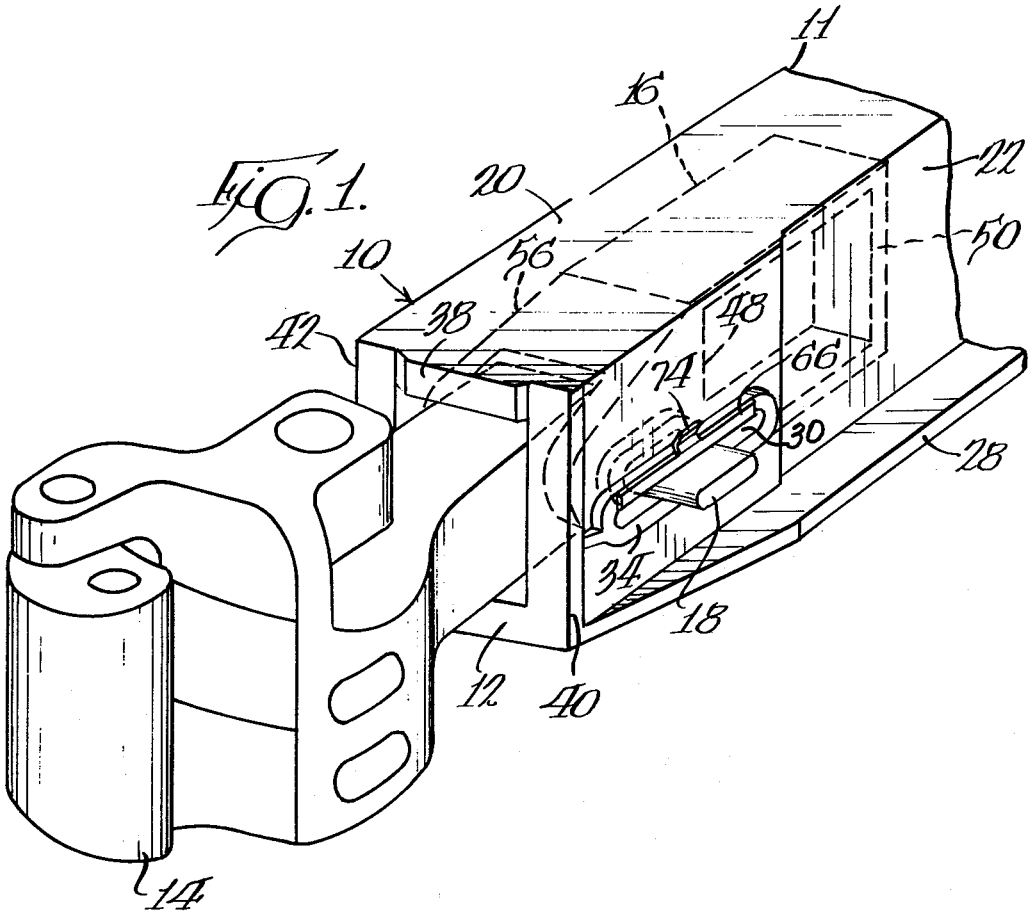
FIG. 1 is a perspective view of an underframe end unit of a railway car with a wear plate positioned between a draft key and a upper bearing surface of one of the sill key slots.

Referring to the drawings, an underframe end unit 10 of a railway car, generally is shown. The end unit includes a conventional double-Z type center sill 11 cast integral with a striker 12. A coupler 14 and its associated yoke 16 are secured to the sill by an elongated draft key 18.

The center sill 11 includes a top web 20, a pair of vertical side walls 22 and 24 extending downwardly therefrom and a pair of laterally outwardly-extending flanges 26 and 28, one along the lower edge of each of the side walls. A pair of aligned key slots 30 and 32 are provided in each of the side walls 22 and 24, respectively. Each of the slots is oblong in shape and is defined by an outer peripheral rib 34 which extends outwardly from the side wall and an inner peripheral rib 36 which extends inwardly from the side wall.

The striker 12 at the terminal end of the sill includes (1) a striker face 38 which extends forwardly of the outboard end of the sill; (2) a pair of striker side walls 40 and 42; and (3) the horizontal coupler carrier structure 44 which supports the coupler.

The coupler 14 (such as the AAR coupler Standard "E" catalog numbers E60OCHT or E67BHT) has a shank 46 with a butt end 48 which is positioned within the sill. An oblong horizontal key slot 47 (see FIG. 3) is provided in the shank intermediate the ends of the coupler.

Figure 3:
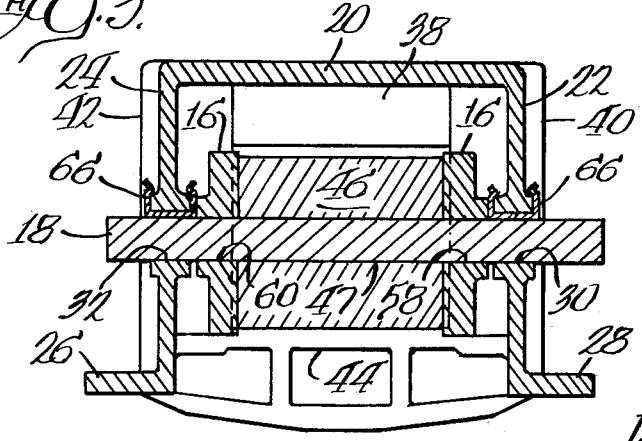
FIG. 3 is a cross-sectional view taken through the draft key and substantially along line 3—3 of FIG. 2.

The yoke 16 (such as AAR Standard Yoke catalog numbers Y40AHT or Y41AHT) has a butt end 50, yoke-straps 52 and 54, and a nose or hood 56 which receives the coupler shank and is shaped to provide therein a pair of oblong horizontal key-slot openings 58 and 60. The key slots in the coupler, yoke and sill can be aligned so that they may be connected by the draft key 18, as best shown in FIG. 3. The draft key is slightly narrower than the sill key slots, extends through the sill key slots, yoke key slots and coupler key slot so as to connect the three members.

Figure 2:
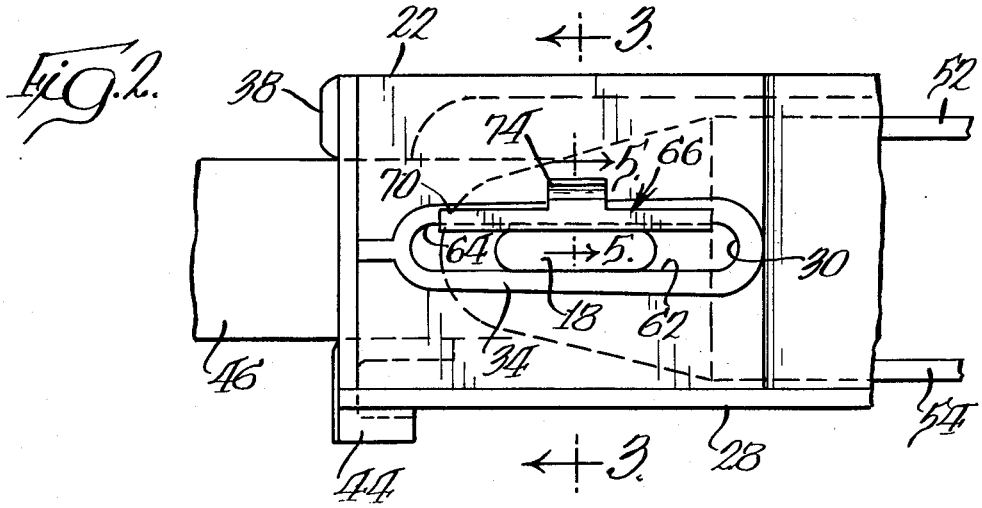
FIG. 2 is a fragmentary side elevational view of the end unit shown in FIG. 1.

Each of the sill key slots 30 and 32 includes a lower bearing surface 62 (see FIG. 2) against which the underside of the draft key 18 bears directly, and an upper bearing surface 64, which is spaced from the lower bearing surface a distance greater than the thickness of the draft key so as to define a space between the upper surface of the draft key and the upper bearing surface. In order to provide this space, the conventional key slot is enlarged by raising the conventional upper bearing surface so that the distance between the upper bearing surface and the lower bearing surface for the improved underframe end unit is greater than in conventional underframe end units. As described hereinafter, a wear plate is positioned in the space between the upper bearing surface 64 and the key 18 so as to protect the upper bearing surface and minimize wear thereto.

Figure 4:
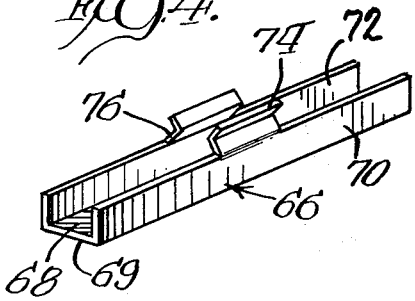
FIG. 4 is an enlarged perspective view of a wear plate of the type shown in FIG. 3.

Referring now to FIG. 4, there is shown an elongated, channel-shaped, clip-on wear plate 66. The plate includes an elongated flat web 68 which provides the wear surface 69, and a pair of side walls or flanges 70 and 72 which extend upwardly from the elongated lateral edges of the web for engaging the inner and outer surfaces of the inner and outer peripheral ribs 34 and 36. Each of a pair of inwardly-extending V-shaped tabs 74 and 76 are centrally positioned along the upper edge of one of the side flanges. The tabs are bent inwardly so as to define a V-shape and so that they fit over and grasp the top edges 78 and 80 of the inner and outer peripheral ribs. This permits the wear plate 66 to be snapped into place without welding and to be removed without cutting. The length of the plate 66 is approximately the same length as the upper bearing surface 64. When assembled, the wear surface 69 is arranged to slidably engage the top surface of the draft key 18 and thereby protect the upper bearing surface 64 from excessive wear.

In order to install the wear plate 66, the draft key 18 is first removed. Then the wear plate 66 is positioned inside the slot with the channel facing upwardly, and the wear plate is urged upward so that inwardly-facing upper camming portions 82 and 84 above the apexes of the V-shaped tabs 74 and 76 engage the lateral edges of the upper bearing surface 64. The wear plate 66 is progressively moved upward to effect camming movement of the V-shaped tabs. Such camming movement will cause the apexes to spread further apart and engage the vertical wall-surfaces of the inner and outer peripheral ribs 34 and 36 so that the side-flanges 70 and 72 flex or bow outwardly.

Figure 5:
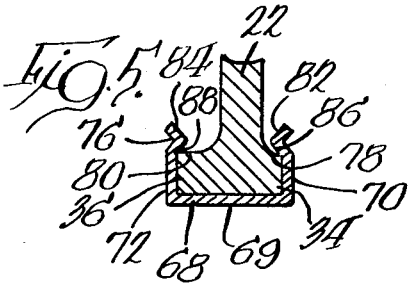
FIG. 5 is a cross-sectional view taken substantially along line 5—5 of FIG. 2.

As the web 68 is moved closer to the upper bearing surface 64, the apexes will slide along the wall-surfaces of the peripheral ribs 34 and 36 until they reach a position slightly above the top edges of the peripheral ribs. At that position, the lower-grasping inwardly-facing camming portions 86 and 88 of the V-shaped tabs below the apexes of said tabs will engage the top edges of the peripheral ribs causing the apexes to slightly move toward each other so that the side-flanges 70 and 72 are urged toward a vertical position. When the web 68 is located against the upper bearing surface 64, the flanges and tabs will snap-back or return to their normally closed position, as best shown in FIG. 5. It is apparent that in the normally closed position the minimum distance between the apexes is less than the thickness of the upper bearing surface. After the wear plate 66 is installed, the draft key 18 is again inserted into the underframe end unit 10.

Figure 7:
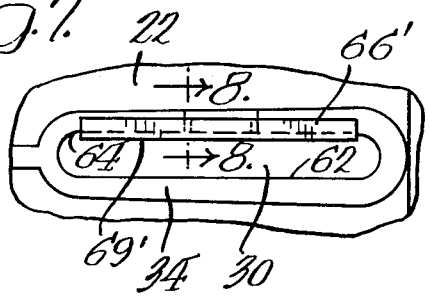
FIG. 7 is an elevational view showing the wear plate of FIG. 6 installed in a key slot.
Figure 6:
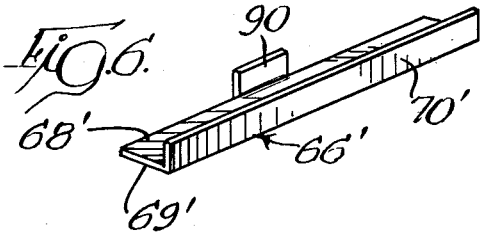
FIG. 6 is a perspective view of a wear plate of a second type.
Figure 8:
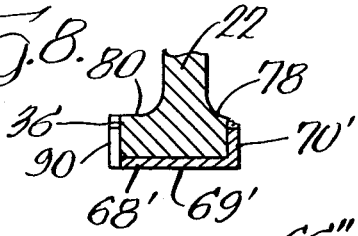
FIG. 8 is a cross-sectional view taken along line 8—8 of FIG. 7.

Referring now to FIGS. 6–8, a second type of wear plate 66' is shown which is constructed for welding in place. The plate is generally L-shaped having an elongated flat web 68' having a wear face 69' and an outer upwardly-extending leg or flange 70' along one edge thereof. A short inner locating tab 90 is centrally positioned along the opposite edge of the web and extends upwardly therefrom. The outer leg 70' and tab 90 are spaced apart a distance which permits the plate to engage the sides of the slot-defining peripheral ribs 34 and 36. The height of the outer leg 70' is less than the height of the slot-defining rib 34 (see FIG. 8) so as to permit the plate 66' to be secured to the sill by welding the upper edge of the outer leg 70' to the outer slot-defining rib 34. Installation of the plate 66' requires removal of the coupler, yoke and draft key as described before. Removal of the plate 66' may be accomplished by torch cutting.

Figure 10:
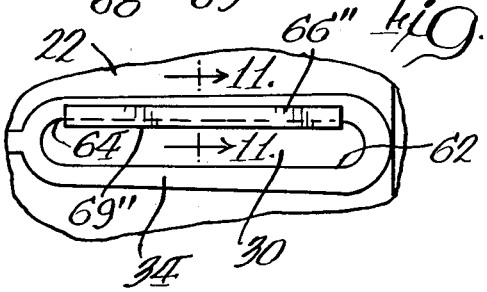
FIG. 10 is an elevational view showing the wear plate of FIG. 9 installed in a key slot.
Figure 9:
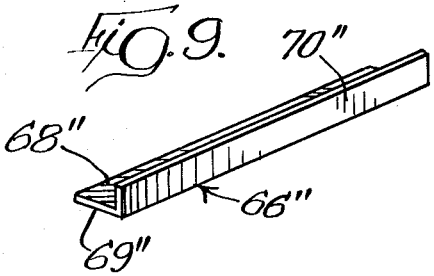
FIG. 9 is a perspective view of a third type of a wear plate which can be installed without removing the coupler.
Figure 11:
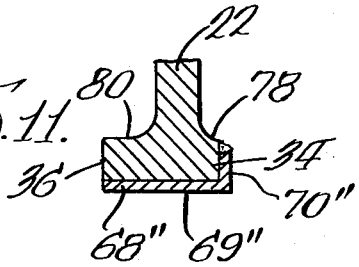
FIG. 11 is a cross-sectional view taken substantially along line 11—11 of FIG. 10.

Referring to FIGS. 9–11, a third type of wear plate 66'' is shown which can be installed and removed without removal of the coupler, yoke and draft key. This plate is generally L-shaped and includes an elongated flat web 68'' having a wear face 69'' and an upstanding outer leg or flange 70''. The plate 66'' is secured to the sill by positioning the wear surface 69'' against the slot upper bearing surface 64 and then welding the outer leg 70'' along its upper edge to the sill. This particular plate has an advantage in that it can be installed or replaced without disassembling the coupler and removing the draft key. In order to install a new plate, the old plate may be removed by torch cutting and the new one is installed by slipping the web 68'' into the space between the draft key 18 and upper bearing surface 64 and then welding the outer leg 70'' to the outer peripheral rib 34.

The draft key 18 is typically formed of unhardened forged steel. In order to resist the rubbing action of the draft key, the wear plates are fabricated of a hardenable carbon steel or alloy steel with the wear surface being hardened to a Brinnel Hardness between 300 to 400. At that hardness the plate is harder than the draft key and the upper bearing surfaces.

In connection with the wear plate 66, although the wear surface is hardened, the V-shaped resilient tabs 74 and 76 are heat-treated to provide the necessary flexibility for the snap-back self-fastening action. In connection with the wear plates 66' and 66'', the outer legs or flanges 70' and 70'' are treated so as to maintain their weldability.

Although an embodiment of the invention has been shown and described, it is to be understood that various modifications and substitutions may be made by those skilled in the art without departing from the novel spirit and scope of the invention. For example, a wear plate in accordance with principles of the present invention can be constructed for use in underframe end units where the striker is not cast integral with the sill.

What is claimed and desired to be secured by Letters Patent of the United States is:

1. A center sill assembly for securing a coupler to said center sill in a railway car, comprising in combination:

a center sill having a pair of side walls, each of said walls having a key slot extending therethrough and an outer peripheral rib surrounding each key slot on the outer side of said wall and an inner peripheral rib surrounding each key slot on the inner side thereof and an upper bearing surface and lower bearing surface for each key slot;

an elongated draft key extending through each key slot and normally biased by the weight of said coupler toward said upper bearing surface of each key slot;

a wear plate for each key slot having elongated and substantially planar web means terminating intermediate the ends of the respective key slot for facile positioning within the respective key slot adjacent said upper bearing surface, said web means having a hardenable wear surface for engagement with the top of the draft key so as to protect the upper bearing surface from the rubbing action of the draft key during motion of the railway car, and flange means for securing each wear plate to said sill at one peripheral rib and for maintaining said web means in position adjacent said upper bearing surface.

2. An assembly as in claim 1, wherein each peripheral rib is integral with the respective sill side wall and the wear plate is L-shaped and said flange means includes an elongated outer leg extending upwardly along an outer longitudinal edge of said elongated web means and fixedly positioned against the outer peripheral rib of the sill.

3. An assembly as in claim 2, wherein the outer peripheral rib defines a top edge positioned above the outer leg so as to provide an area for welding the leg to the outer peripheral rib.

4. An assembly as in claim 1, wherein each peripheral rib is integral with a respective side wall and said flange means includes an elongated outer leg extending upwardly along an outer longitudinal edge of said elongated web means and fixedly positioned against the outer peripheral rib, and tab means extending upwardly along an inner longitudinal edge of said web means opposite said leg and positioned against the inner peripheral rib.

5. An assembly as in claim 4, wherein the outer peripheral rib defines a top edge positioned above the leg so as to provide an area for welding the leg to the outer peripheral rib.

6. An assembly as in claim 1, wherein the wear plate is a channel-shaped member having a flat web with a hardened face for engaging said draft key to define said planar web means and includes a pair of elongated side flanges extending upwardly from the elongated edges of said web means to define said flange means and positioned to abut therebetween the peripheral ribs, and a pair of flexible tab means, one on each of said side flanges at the upper edge thereof for releasably grasping the top edges of the peripheral ribs and to facilitate attachment and removal of the wear plate.

* * * * *